United States Patent [19]

Glessner

[11] 4,103,969

[45] Aug. 1, 1978

[54] ADJUSTABLE WOODEN STUDIO BENCH

[76] Inventor: James Stoy Glessner, R.D. #2, Somerset, Pa. 15501

[21] Appl. No.: 807,353

[22] Filed: Jun. 17, 1977

[51] Int. Cl.[2] ..... A47C 3/28

[52] U.S. Cl. ..... 297/311; 297/440; 108/111

[58] Field of Search ..... 297/311-313, 297/192, 193, 440, 461, 437; 108/1, 111, 106; 248/429

[56] References Cited

U.S. PATENT DOCUMENTS

| | | | |
|---|---|---|---|
| 286,457 | 10/1883 | Magoun | 248/429 |
| 909,336 | 1/1909 | Riedy | 108/106 |
| 2,569,555 | 10/1951 | Chanslor et al. | 108/111 |
| 2,903,047 | 9/1959 | Funyak | 297/311 |
| 2,917,104 | 12/1959 | Coffle | 297/437 X |
| 3,744,845 | 7/1973 | Sooker | 297/461 |

*Primary Examiner*—Francis K. Zugel
*Attorney, Agent, or Firm*—Brown, Flick & Peckham

[57] ABSTRACT

An adjustable wooden studio bench has four legs, the upper portions of which are connected by a pair of horizontal top rails provided with vertical openings through which the legs extend. A horizontal footrest rail like the top rails is mounted on the lower portions of the legs. The front legs are connected with the back legs by means of cross bars with vertical openings for the legs. The cross bars may support a tray. Each rail and bar has a vertical slot through each end extending from the opening out through the adjacent end to form a pair of horizontally spaced jaws that are drawn toward each other by a fastener extending through them to clamp the rails and bars to the legs. When the fasteners are loosened, the rails and bars can be moved vertically on the legs. The top rails support a seat that is slidable lengthwise of them.

2 Claims, 4 Drawing Figures

ADJUSTABLE WOODEN STUDIO BENCH

It is among the objects of this invention to provide a wooden bench which is provided with a seat slidable lengthwise thereof, which has a vertically adjustable footrest, which has a vertically adjustable tray, and which permits the elevation and angle of the seat to be adjusted.

The preferred embodiment of the invention is illustrated in the accompanying drawings, in which FIG. 1 is a plan view;

Figure 1:
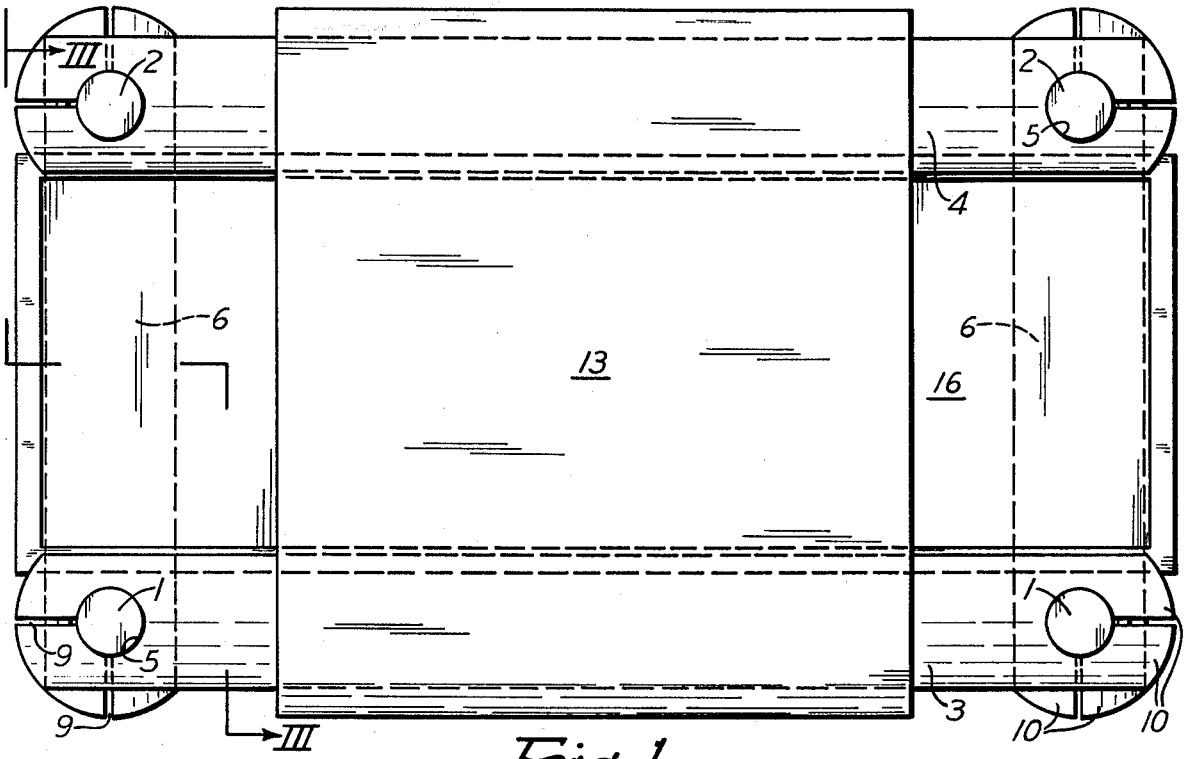

Referring to the drawings, the wooden bench is provided with two post-like front legs 1 and two back legs 2, all of which are identical and the same size from top to bottom. The upper portions of the front legs are connected by a top rail 3 and the back legs are connected by a like top rail 4 parallel to the front rail. Each of these rails has a circular vertical opening 5 through it, through which the legs extend. Shorter parallel bars 6 connect the front legs to the back legs at a lower level than the top rails. They, too, are provided with vertical openings receiving the legs.

Figure 4:
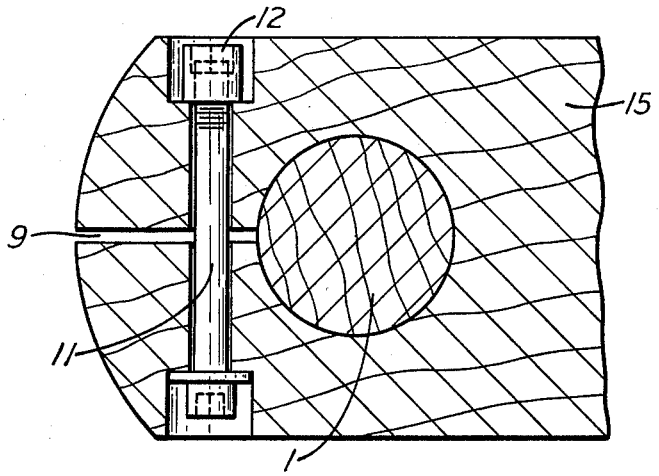
FIG. 4 is an enlarged fragmentary horizontal section of a leg and rail, taken on the line IV—IV of FIG. 2.

In order to permit the rails and bars to be adjusted vertically on the legs and yet be securely connected to the legs after the desired adjustments have been made, each rail and bar has a vertical slot 9 through each end extending from the opening therethrough out through the adjacent end of the rail or bar to form a pair of horizontally spaced jaws 10. Fastening means, such as a bolt 11 and nut 12 extend through each pair of jaws so that by tightening the bolt the jaws can be drawn closer together to cause the jaws to tightly grip the circular legs as shown in FIG. 4. The nuts and bolt heads are countersunk in the jaws. By loosening the nuts, the rails or bars can be slid up or down the legs to another location and then clamped onto the legs again.

Figure 3:
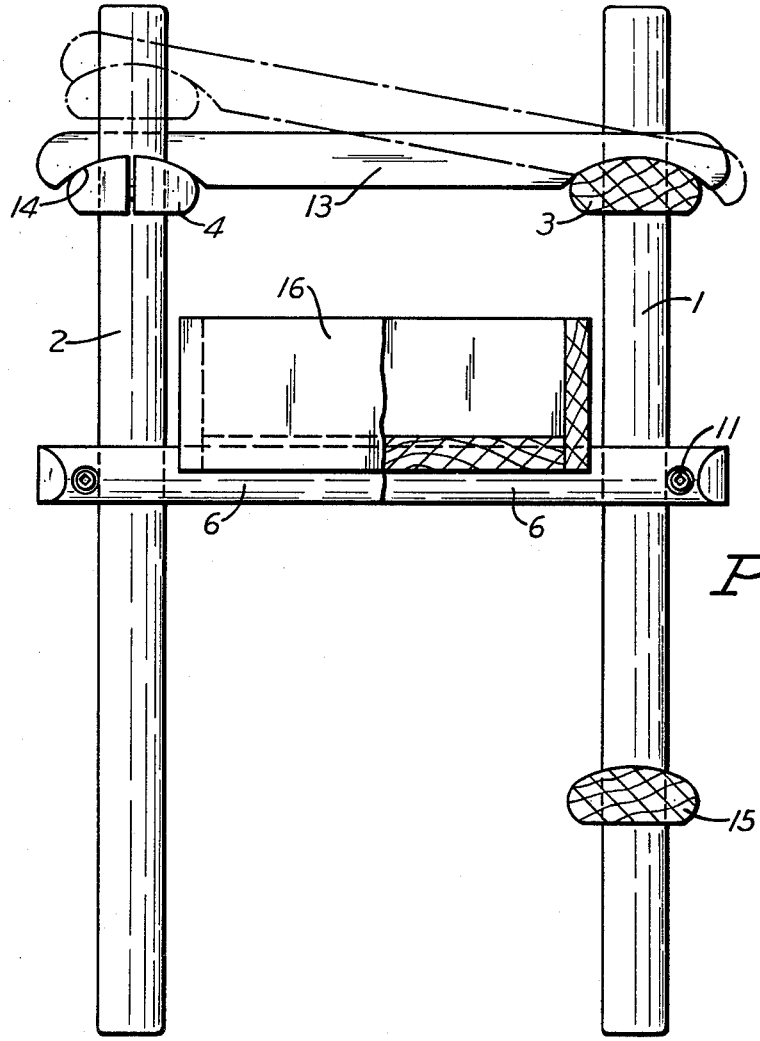
FIG. 3 is an end view and cross section taken on the line III—III of FIG. 1.

The two top rails support a seat 13 that is considerably shorter than the bench as a whole. The seat merely rests on the rails so that it can be slid lengthwise of the bench to any desired position. To prevent the seat from moving forward or backward and thus slipping off the rails, the bottom of the seat is provided with grooves 14 receiving the upper portions of the top rails as shown in FIG. 3. It also is desirable to have the center portion of the seat extend down between the rails in engagement with them.

A bottom rail or footrest rail 15, made like the top rails, is clamped onto the lower portions of the front legs and likewise can be adjusted vertically. It also helps to stabilize the bench.

It is sometimes desirable to change the angle of the seat so that it slopes either forward or backward, according to the desire of the person using the bench. This can be done by raising or lowering one of the top rails relative to the other one as indicated in dotted lines in FIG. 3. To preserve substantially the same areas of contact between the seat and rails when the seat is inclined, and thus avoid line contacts, the upper surface of each top rail is convex transversely to form a segment of a cylinder as shown in FIG. 3. Also, the grooves 14 in the seat have transversely curved surfaces fitting the curvature of the top rails. Consequently, when one rail is adjusted vertically relative to the other one as shown in dotted lines, the curved surfaces of the seat and rails will remain in contact.

Figure 2:
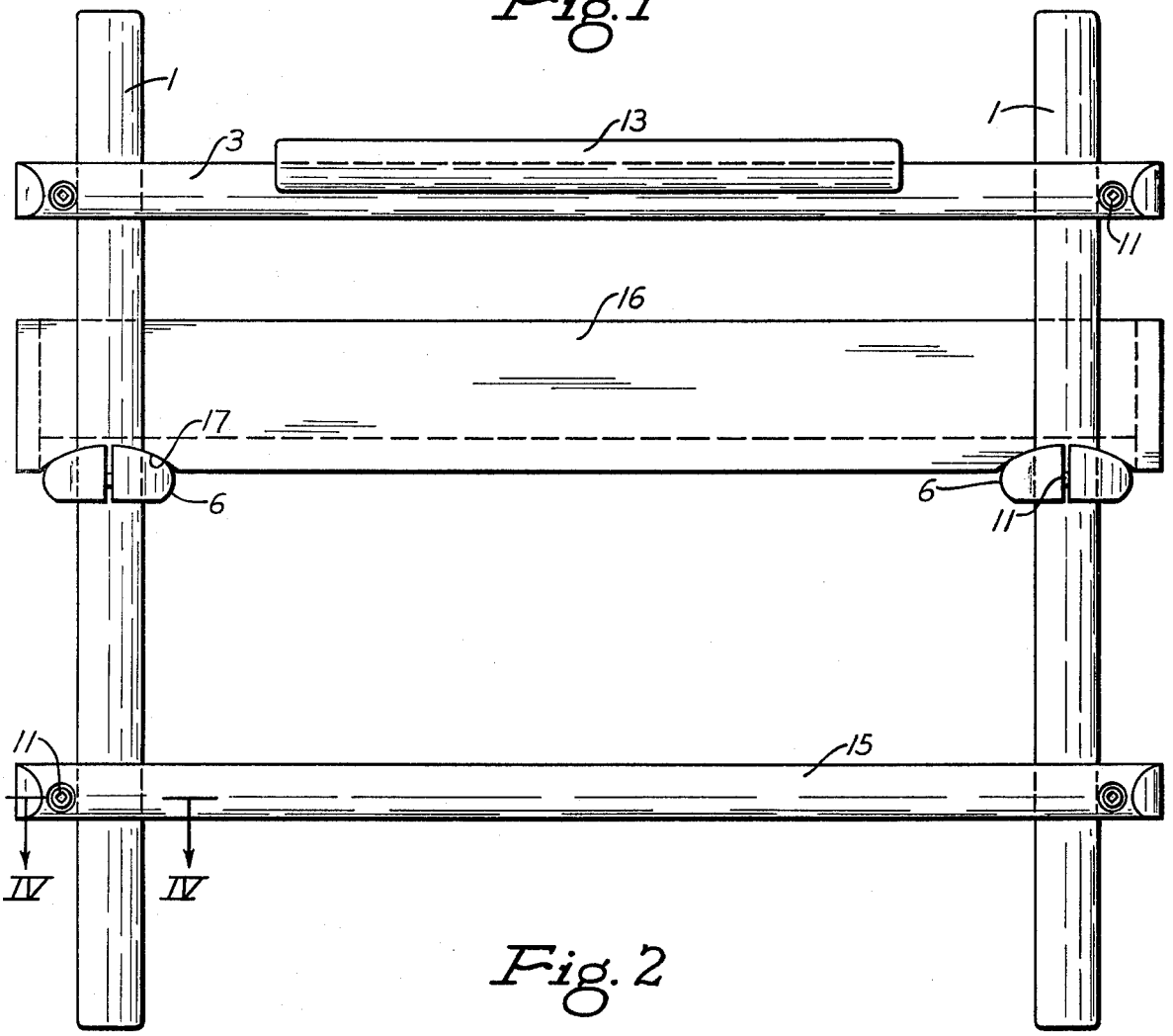
FIG. 2 is a front view.

Another feature is a tray 16, which rests on the cross bars 6 beneath the top rails and seat. The front and back sides of the tray extend below the bottom of the tray and are provided with concave notches 17 that fit the convex surfaces of the cross bars as shown in FIG. 2. This projection of the cross bars up into the notches prevents accidental movement of the tray lengthwise of the bench, but allows the tray to be removed easily from the bench if desired.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An adjustable wooden studio bench comprising a pair of front legs spaced lengthwise of the bench, a horizontal top rail provided at its ends with vertical openings receiving the upper portions of said legs, a horizontal footrest rail provided at its ends with vertical openings receiving the lower portions of said legs, a back leg behind each front leg, a second horizontal top rail provided at its ends with vertical openings receiving the upper portions of said back legs, a cross bar at each end of the bench provided at its ends with vertical openings receiving the central portions of the adjoining front and back legs, each rail and bar having a vertical slot through each end extending from the opening therethrough out through the adjacent end to form a pair of horizontally spaced jaws, fastening means extending through each pair of jaws and drawing them toward each other to clamp the rails and bars at any desired height on the legs extending therethrough, and a seat resting on said top rails and slidable only lengthwise thereof the upper surfaces of said top rails being convex transversely of the rails, each of said surfaces forming a segment of a cylinder, and the bottom of said seat being provided with concave grooves receiving said convex surfaces, the wall surface of each groove forming a segment of a cylinder, all of said surfaces having substantially the same radius so that said wall surfaces fit said upper surfaces of the top rails when those rails are at the same level and also when one of them is lower than the other one to slant the seat whereby line contact between the seat and the top rails is avoided.

2. A studio bench according to claim 1, in which said seat has a bottom portion extending down between the top rails and engaging them to prevent movement of the seat transversely of those rails.

* * * * *